US011375593B2

(12) United States Patent
Sohma

(10) Patent No.: US 11,375,593 B2
(45) Date of Patent: Jun. 28, 2022

(54) LIGHTING SYSTEM PROVIDED WITH DIMMER APPARATUS AND LIGHTING EQUIPMENT

(71) Applicant: Nisshinbo Micro Devices Inc., Tokyo (JP)

(72) Inventor: Shohtaroh Sohma, Ikeda (JP)

(73) Assignee: NISSHINBO MICRO DEVICES INC., Tokyo (JP)

( * ) Notice: Subject to any disclaimer, the term of this patent is extended or adjusted under 35 U.S.C. 154(b) by 0 days.

(21) Appl. No.: 17/276,518

(22) PCT Filed: May 21, 2020

(86) PCT No.: PCT/JP2020/020086
§ 371 (c)(1),
(2) Date: Mar. 16, 2021

(87) PCT Pub. No.: WO2021/234899
PCT Pub. Date: Nov. 25, 2021

(65) Prior Publication Data

US 2022/0117056 A1 Apr. 14, 2022

(51) Int. Cl.

| | |
|---|---|
| ***H05B 45/14*** | (2020.01) |
| ***H05B 45/32*** | (2020.01) |
| ***H05B 45/325*** | (2020.01) |
| ***H05B 47/185*** | (2020.01) |

(52) U.S. Cl.
CPC ..... *H05B 45/325* (2020.01); *H05B 45/14* (2020.01); *H05B 47/185* (2020.01)

(58) Field of Classification Search
CPC ..... H05B 45/10; H05B 45/14; H05B 45/325; H05B 47/10; H05B 47/14; H05B 47/185
See application file for complete search history.

(56) References Cited

U.S. PATENT DOCUMENTS

2017/0231042 A1* 8/2017 Willaert ..... H05B 45/375

FOREIGN PATENT DOCUMENTS

| | | |
|---|---|---|
| JP | 6170995 | 7/2017 |
| JP | 2018-18764 | 2/2018 |
| JP | 2019-169432 | 10/2019 |

* cited by examiner

*Primary Examiner* — Jimmy T Vu
(74) *Attorney, Agent, or Firm* — Paul Teng

(57) ABSTRACT

A lighting system is provided with a dimmer apparatus and lighting equipment that are connected to each other via a two-wire power supply line. The dimmer apparatus generates a DC voltage including a dimming PWM signal having a PWM amplitude corresponding to a dimming control signal, and outputs the DC voltage to the lighting equipment. The lighting equipment includes at least one light emitting element that emits light by a DC current based on the DC voltage, and a current control circuit. The second control circuit modulates the dimming PWM signal included in the DC voltage, and controls brightness of the light emitting element, so that a DC current corresponding to a duty ratio of a modulated dimming PWM signal flows through the light emitting element based on the duty ratio of the dimming PWM signal.

8 Claims, 10 Drawing Sheets

LIGHTING SYSTEM PROVIDED WITH DIMMER APPARATUS AND LIGHTING EQUIPMENT

TECHNICAL FIELD

The present invention relates to a lighting system including a dimmer apparatus and lighting equipment.

BACKGROUND ART

A conventional lighting system using various dimming control methods such as a phase dimmer control method, a PWM (Pulse Width Modulation) dimmer control method, a wireless dimmer control method, and a PLC (Power Line Communication) dimmer control method for adjusting brightness of an LED (Light Emitting Diode) lighting equipment has been known.

For example, Patent Document 1 discloses a lighting system that controls light while suppressing sudden voltage fluctuations generated by a phase control method by changing the conduction of a sinusoidal AC (Alternating Current) waveform for half a cycle for the purpose of reducing noise.

In addition, Patent Document 2 discloses a lighting system that controls light of lighting equipment by converting a sinusoidal wave AC voltage into a DC (Direct Current) voltage in advance by an AC-DC converter, superimposing transmitting data on the DC voltage, and decoding the transmitting data by the lighting equipment.

Further, Patent Document 3 discloses a lighting system including: a controller configured to perform power line communication; and a lighting control unit including a master unit configured to perform power line communication and lighting equipment capable of communicating with the master unit, for the purpose of enabling control using power line communication while suppressing an increase in equipment cost. In this case, the master unit and the lighting equipment communicate with each other by communication means different from the power line communication.

PRIOR ART DOCUMENTS

Patent Documents

[Patent Document 1] Japanese Patent No. JP6170995B
[Patent Document 2] Japanese Patent Laid-open Publication No. JP2018-018764A
[Patent Document 3] Japanese Patent Laid-open Publication No. JP2019-169432A

SUMMARY OF THE INVENTION

Problems to be Solved by the Invention

However, in Patent Document 1, the lighting equipment requires a microcomputer and a memory as a control circuit, and this results in increase in the cost. In addition, since the sinusoidal AC waveform is applied to the light source, an AC-DC converter is required, and this results in being not suitable for miniaturization. Further, although it is not disclosed, since it is necessary to turn on the light source in a state where zero level is applied, it is expected that a bulk capacitor that is about twice as large as that in a normal AC-DC converter to which a sinusoidal AC waveform is applied is required. The bulk capacitor is one of the largest components of an AC-DC converter, and if the size of the bulk capacitor is about twice the original size, the size of lighting equipment further increases.

In addition, in Patent Document 2, the lighting equipment requires a microcomputer and a memory as a control circuit, which increases the cost. In addition, since the lighting equipment includes a DC-DC converter (step-down chopper), although the size of the DC-DC converter is smaller than that of an AC-DC converter, the DC-DC converter hinders miniaturization and increases costs. Further, although a bulk capacitor is required for the DC-DC converter, since the transmitting signal is a rectangular wave, it is assumed that a large inrush current occurs and causes noise. Therefore, in actual use, a large-sized noise filter is required, and this results in further increase in the costs and causes an increase in size.

Further, in Patent Document 3, a light adjuster requires a microcontroller circuit for converting input information from an input interface into a PLC signal. On the other hand, each LED lighting equipment requires a switching power supply circuit, which increases the size and costs, and also requires a microcontroller circuit to decode the PLC signal, which is costly. Further, the PLC signal includes a high-frequency component, which generates high-frequency noise and causes a malfunction of other devices.

An object of the present invention is to solve the above problems and to provide a lighting system having a simple structure, capable of being miniaturized, having less noise, and being easy to install as compared with the prior art.

According to one aspect of the present invention, there is provided a lighting system comprising a dimmer apparatus and lighting equipment that are connected to each other via a two-wire power supply line. The dimmer apparatus generates a DC voltage including a dimming PWM signal having a PWM amplitude corresponding to a dimming control signal, and outputs the DC voltage to the lighting equipment. The lighting equipment includes at least one light emitting element that emits light by a DC current based on the DC voltage; and a current control circuit. The second control circuit modulates the dimming PWM signal included in the DC voltage, and controls brightness of the light emitting element, so that a DC current corresponding to a duty ratio of a modulated dimming PWM signal flows through the light emitting element based on the duty ratio of the dimming PWM signal.

Effect of the Invention

Therefore, the lighting system according to the present invention has a simple structure, can be miniaturized, has less noise, and is easy to install as compared with the prior art.

MODE FOR CARRYING OUT THE INVENTION

Figure 1:
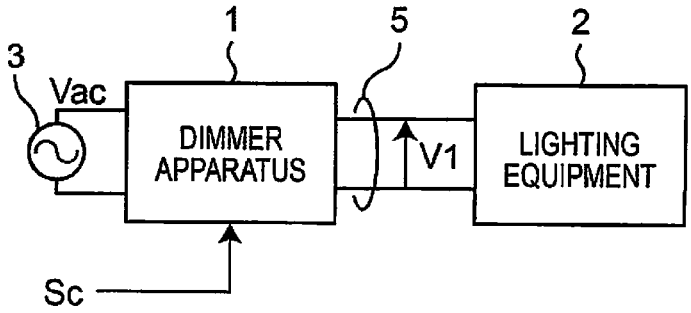
FIG. 1 is a block diagram illustrating a configuration example of a lighting system according to a first embodiment.

Hereinafter, embodiments according to the present invention will be described with reference to the drawings. It is noted that the same or similar components are designated by the same reference numerals.

Features of Embodiments

Embodiments according to the present invention have the following features in a lighting system capable of dimming or adjusting light.

(1) A dimming PWM signal is superimposed on a DC voltage generated in advance by an AC-DC converter, the DC voltage including the PWM signal is transmitted to lighting equipment via a two-wire power supply line, and the DC voltage is used as a power supply voltage of the lighting equipment.

(2) The lighting equipment is equipped with a light emitting element, which is, for example, a light emitting diode (LED), the PWM signal is rectified and demodulated by a low-pass filter, and the brightness of the light emitting element is controlled according to the duty ratio of the demodulated PWM signal.

First Embodiment

FIG. 1 is a block diagram illustrating a configuration example of a lighting system according to a first embodiment. Referring to FIG. 1, the lighting system includes a dimmer apparatus 1 and lighting equipment 2 that are connected to each other via a two-wire power supply line 5.

The dimmer apparatus 1 generates a DC voltage including a PWM signal having a plurality of PWM amplitudes (hereinafter, referred to as amplitudes) corresponding to a predetermined dimming control signal Sc, based on an AC voltage Vac from an AC power supply 3, and outputs the DC voltage to the lighting equipment 2 via the two-wire power supply line 5. The lighting equipment 2 includes at least one light emitting element, for example, a series circuit of a plurality of LEDs, that has a forward voltage VF (meaning a voltage required to make the light emitting element emit light) lower than the DC voltage inputted from the dimmer apparatus 1, and emits light by a DC current based on the DC voltage. In this case, the lighting equipment 2 includes a current control circuit that demodulates the PWM signal included in the DC voltage, and controls the brightness of the light emitting element, so that the DC current corresponding to the duty ratio of the PWM signal flows through the light emitting element.

Figure 2:
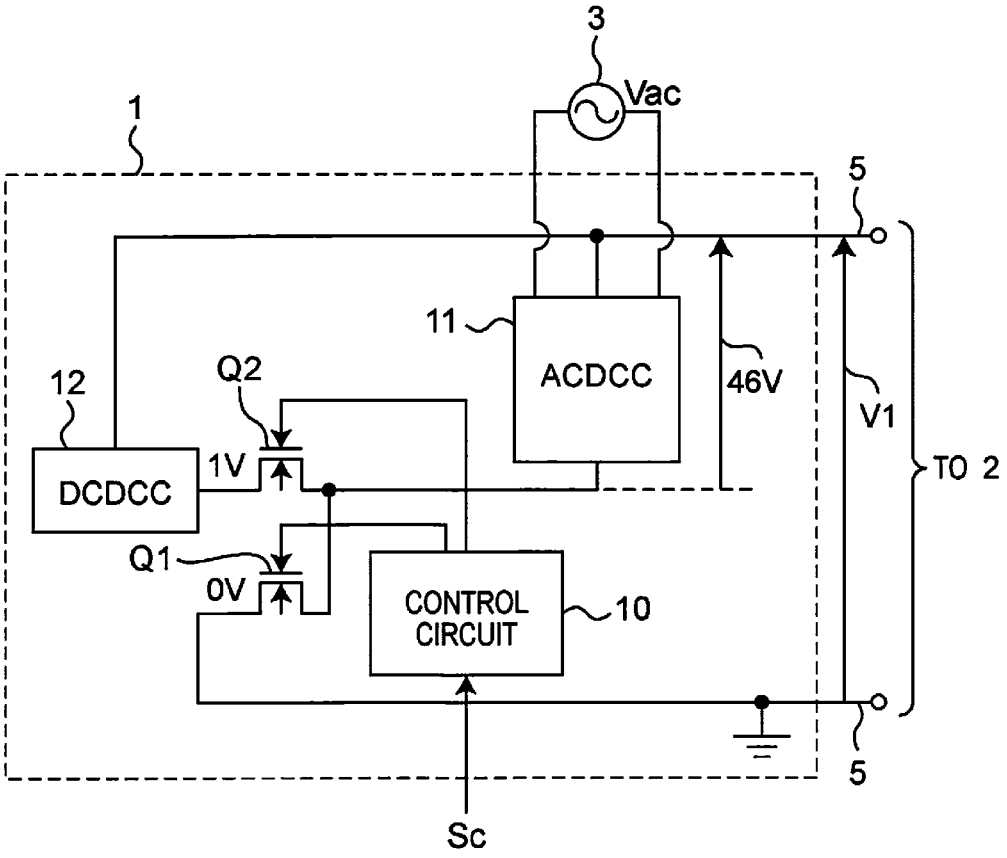
FIG. 2 is a block diagram illustrating a configuration example of a dimmer apparatus 1 of FIG. 1.

FIG. 2 is a block diagram illustrating a configuration example of the dimmer apparatus 1 of FIG. 1.

Referring to FIG. 2, the dimmer apparatus 1 includes: a control circuit 10; an AC-DC converter (denoted as ACDCC in the drawing) 11; a DC-DC converter (denoted as DCDCC in the drawing) 12; and two N-channel MOS field-effect transistors (hereinafter, MOS field-effect transistors are referred to as MOS transistors) Q1 and Q2. In this case, the dimmer apparatus 1 superimposes a dimming PWM signal on a DC voltage of, for example, 46 V generated by the AC-DC converter 11 to generate a dimming power supply voltage V1 for the lighting equipment 2, and outputs the dimming power supply voltage V1 to the lighting equipment 2 via the two-wire power supply line 5. In addition, the MOS transistors Q1 and Q2 are used as switching elements.

Referring to FIG. 2, the AC-DC converter 11 generates, for example, a DC voltage of 46V from an AC voltage Vac from an AC power supply 3, which is a commercial power supply. In this case, it is preferable that the AC-DC converter 11 is equipped with a power factor improving circuit (PFC) for preventing harmonics and improving the power factor. A positive electrode of the output terminal of the AC-DC converter 11 is connected to a positive electrode of the DC-DC converter 12 and a positive electrode of the two-wire power supply line 5. The negative electrode of the output terminal of the AC-DC converter 11 is grounded via drain and source of the MOS transistor Q1, and is connected to the output terminal of the DC-DC converter 12 via drain and source of the MOS transistor Q2. The DC-DC converter 12 converts the DC voltage generated by the AC-DC converter 11 into, for example, an output voltage of 1 V, to generate the output voltage, and outputs the generated 1 V output voltage from the output terminal to the negative terminal of the AC-DC converter 11 via the source and drain of the MOS transistor Q2. It is noted that a negative electrode of the two-wire power supply line 5 is grounded.

The control circuit 10 is, for example, a microcontroller, receives a dimming control signal having a predetermined dimming signal level from an input interface circuit installed on a wall surface, for example, turns on or off the MOS transistors Q1 and Q2 correspondingly to the dimming signal level of the dimming control signal to generate a PWM signal of 0 V to 1 V, and apply the PWM signal to the negative terminal of the AC-DC converter 11 as a reference voltage of the AC-DC converter 11.

In this case, when the MOS transistor Q1 is turned on and the MOS transistor Q2 is turned off, the reference voltage of the AC-DC converter 11 is 0 V. In addition, when the MOS transistor Q1 is turned off and the MOS transistor Q2 is turned on, the reference voltage of the AC-DC converter 11 is 1 V.

The dimming power supply voltage V1 from the dimmer apparatus 1 configured as described above is a power supply voltage including a superimposed PWM signal that changes between 46 V and 47 V.

Figure 3:
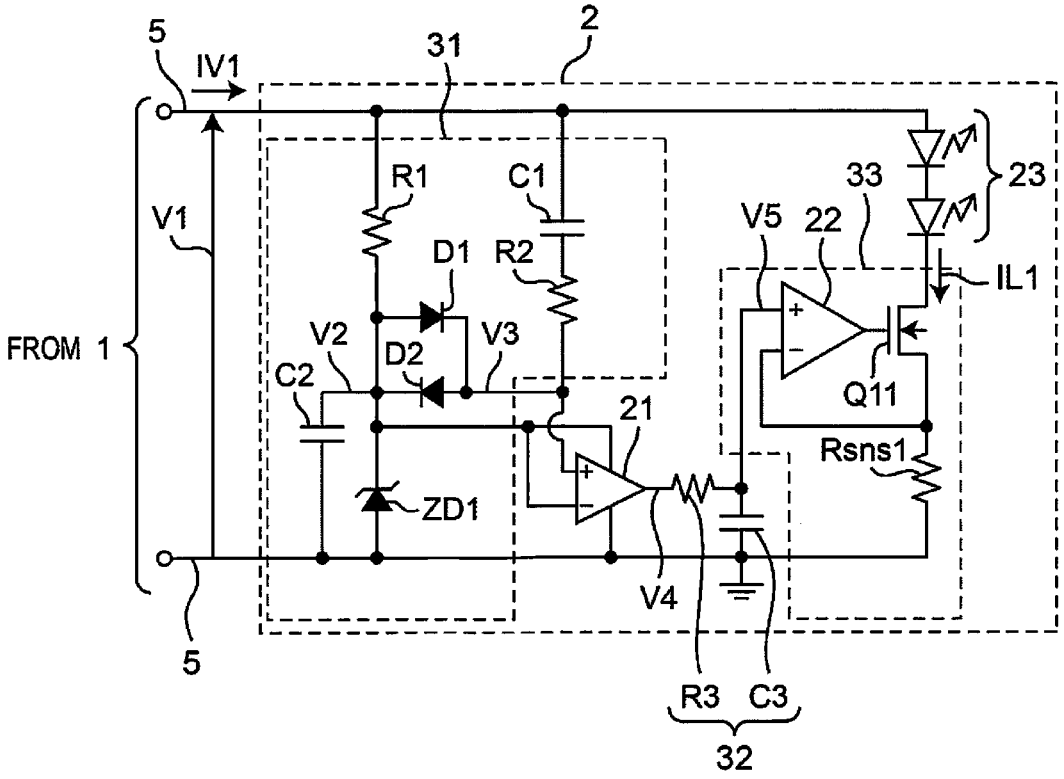
FIG. 3 is a circuit diagram illustrating a configuration example of lighting equipment 2 of FIG. 1.
Figure 4:
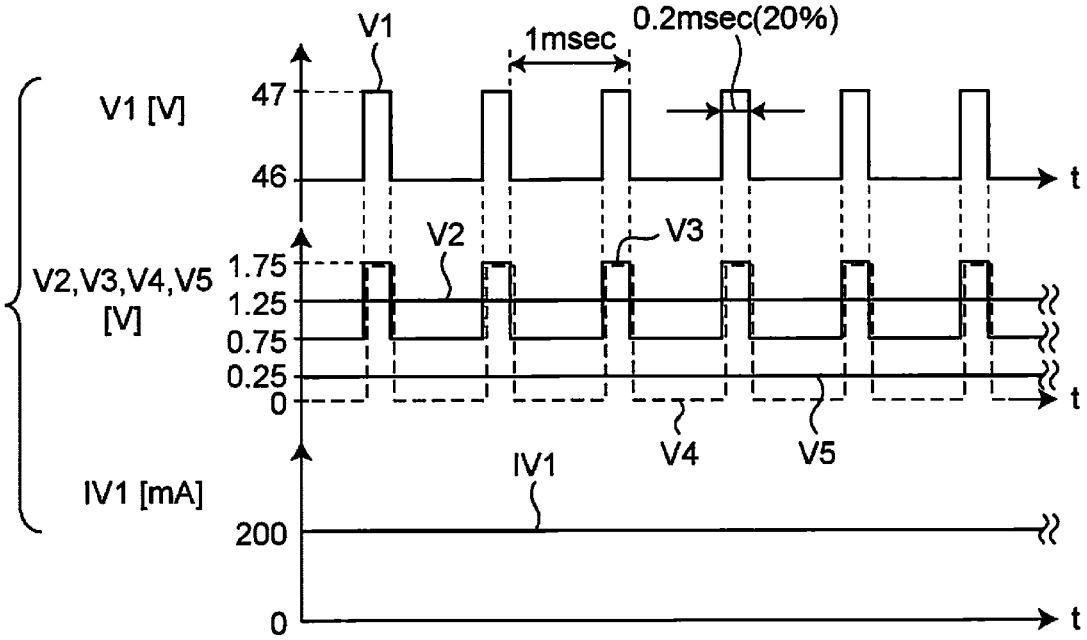
FIG. 4 is a timing chart of each of voltage waveforms and current waveforms, illustrating an operation example of the lighting system of FIG. 1.

FIG. 3 is a circuit diagram illustrating a configuration example of the lighting equipment 2 of FIG. 1, and FIG. 4 is a timing chart of each of voltage waveforms and current waveforms, illustrating an operation example of the lighting system of FIG. 1. It is noted that a voltage V4 changes in synchronization with voltages V1 and V3, but if these are superimposed and illustrated in the drawing, the voltage waveform becomes unclear. Therefore, for convenience of illustration, the voltage V4 is slightly shifted in the time direction from the voltages V1 and V3 in the drawing.

Referring to FIG. 3, the lighting equipment 2 includes a voltage shift circuit 31, a comparator 21, a low-pass filter 32, a current control circuit 33, and a light emitting element 23. In this case, the light emitting element 23 is, for example, a series circuit of a plurality of LEDs. The lighting equipment 2 receives the dimming power supply voltage V1, on which a PWM signal of 46 V to 47 V is superimposed from the dimmer apparatus 1 of FIG. 2, causes the light emitting element 23 to emit light, and controls light adjustment.

Referring to FIG. 3, the voltage shift circuit 31 includes resistances R1 AND R2, capacitors C1 and C2, diodes D1 and D2, and a zener diode ZD1. The positive electrode of the two-wire power supply line 5 is connected to one end of the two diodes D1 and D2 connected in parallel in directions opposite to each other via the resistance R1, and connected to another end of the two diodes D1 and D2 via the series circuit of the capacitor C1 and the resistance R2. One end of the two diodes D1 and D2 is grounded via the capacitor C2, and also grounded via the zener diode ZD1.

In this case, the reference voltage V2 at a connection between the resistance R1 and the capacitor C2 is applied to a positive power supply terminal of the comparator 21 in the subsequent stage, and is grounded to the negative terminal of the power supply voltage of the comparator 21.

In the voltage shift circuit 31 configured as described above, the resistance R1 allows a bias current to flow through the zener diode ZD1 based on the dimming power supply voltage V1 from the dimmer apparatus 1, so that the zener diode ZD1 generates a reference voltage V2 of 1.25 V. It is noted that the capacitor C2 connected in parallel with the zener diode ZD1 has a smoothing capacitance. In addition, the diodes D1 and D2 have a forward voltage VF of, for example, 0.5 V. The capacitor C1 shifts the level of the PWM amplitude of the dimming power supply voltage V1 to the voltage V3, and outputs the resulting voltage to a non-inverting input terminal of the comparator 21. Further, the resistance R2 is provided to limit an inrush current from the capacitor C1 to the diodes D1 and D2.

The signal voltage inputted to the non-inverting input terminal of the comparator 21 is clamped by the forward voltage VF of the diodes D1 and D2, so that signal voltage is the voltage V3 of the PWM signal that changes between 0.75 V and 1.75 V. Therefore, the voltage shift circuit 31 is configured to shift the voltage of the PWM signal included in the dimming power supply voltage V1 that changes between 46 V and 47 V to the voltage V3 of the PWM signal that changes between 0.75 V and 1.75 V.

The voltage V2 across the zener diode ZD1 is inputted to the inverting input terminal of the comparator 21. Therefore, the output voltage V4 of the comparator 21 is the voltage of the PWM signal that changes between 0 V and 1.25 V. Therefore, the voltage shift circuit 31 and the comparator 21 shift the voltage of the PWM signal included in the dimming power supply voltage V1 that changes between 46 V and 47 V to the voltage V4 of the PWM signal that changes between 0 V and 1.25 V.

The low-pass filter 32 is configured by connecting the resistance R3 and the capacitor C3 in an L shape, and smooths the output voltage V4 of the comparator 21 to generate a voltage V5.

The current control circuit 33 is a circuit that drives and controls the current of the light emitting element 23, and includes an operational amplifier 22, an N-channel MOS transistor Q11, and a resistance Rsns1. One end of the light emitting element 23 is connected to the positive electrode of the two-wire power supply line 5, and another end of the light emitting element 23 is connected to the negative electrode of the two-wire power supply line 5 grounded via the drain and source of the MOS transistor Q11 and the resistance Rsns1. In this case, the resistance Rsns1 is provided to detect a current IL1 flowing through the light emitting element 23, and the voltage across the resistance Rsns1 is proportional to the current ILL The operational amplifier 22 applies the voltage obtained by subtracting the voltage across the resistance Rsns1 from the voltage V5 to the gate of the MOS transistor Q11, controls the gate voltage to be applied to the MOS transistor Q11, so that the voltage V5 and the voltage across the resistance Rsns1 substantially match each other. Therefore, assuming that the current flowing through the resistance Rsns1 is ILL the current IL1 is feedback-controlled to be as follows.

$$IL1 = PWM \text{ signal duty ratio} \times 1.25/Rsns1$$

Therefore, the operational amplifier 22, the MOS transistor Q1, and the resistance Rsns1 form a feedback control circuit that controls the current IL1 flowing through the light emitting element 23. It is noted that since the current IL1 flowing through the light emitting element 23 is sufficiently larger than the current flowing through the voltage shift circuit 31, a current IV1 flowing through the lighting equipment 2 is substantially equal to the current IL1.

The operation of the lighting equipment 2 configured as described above will be described below with reference to the timing chart of FIG. 3. In this case, the period of the PWM signal is 1 msec (frequency 1 kHz), the duty ratio of the PWM signal is 20% (0.2 msec), and the resistance value of the resistance Rsns is 1.25Ω.

As is clear from FIG. 3, the voltage V1 including the PWM signal that changes between 46 V and 47 V is shifted through the voltage V3 to the voltage V4 including the PWM signal that changes between 0.75 V and 1.75 V. In FIG. 3, the current IL1 is expressed by the following equation:

$$IL1 = 20\% \times 1.25\ V/1.25\Omega = 200\ mA.$$

In addition, the current IV1 is the input current to the lighting equipment 2, but the current IV1 almost matches the current ILL and it can be seen that there is almost no noise.

According to the lighting system according to the first embodiment configured as described above, the dimmer apparatus 1 generates the DC voltage V1 including the dimming PWM signal having a plurality of amplitudes corresponding to the dimming control signal, and outputs the DC voltage V1 to lighting equipment 2. In addition, the lighting equipment 2 includes:

the light emitting element 23 that has the forward voltage VF lower than the DC voltage V1 inputted from the dimmer apparatus 1 and emits light by the DC current IL1 based on the DC voltage V1; and a current control circuit that demodulates the dimming PWM signal included in the DC voltage V1 and controls the brightness of the light emitting element 23, so that the DC current IL corresponding to the duty ratio of the demodulated dimming PWM signal flows through the light emitting element 23.

Therefore, the lighting system according to the first embodiment has the following unique effects.

(1) Since the lighting equipment 2 does not require a control circuit such as a microcomputer and a memory and a bulk capacitor, the configuration is simple, the size can be reduced, and the noise is small as compared with the prior art.

(2) Since the dimmer apparatus 1 and the lighting equipment 2 are connected to each other via the two-wire power supply line 5, the construction is extremely easy.

Second Embodiment

Figure 5:
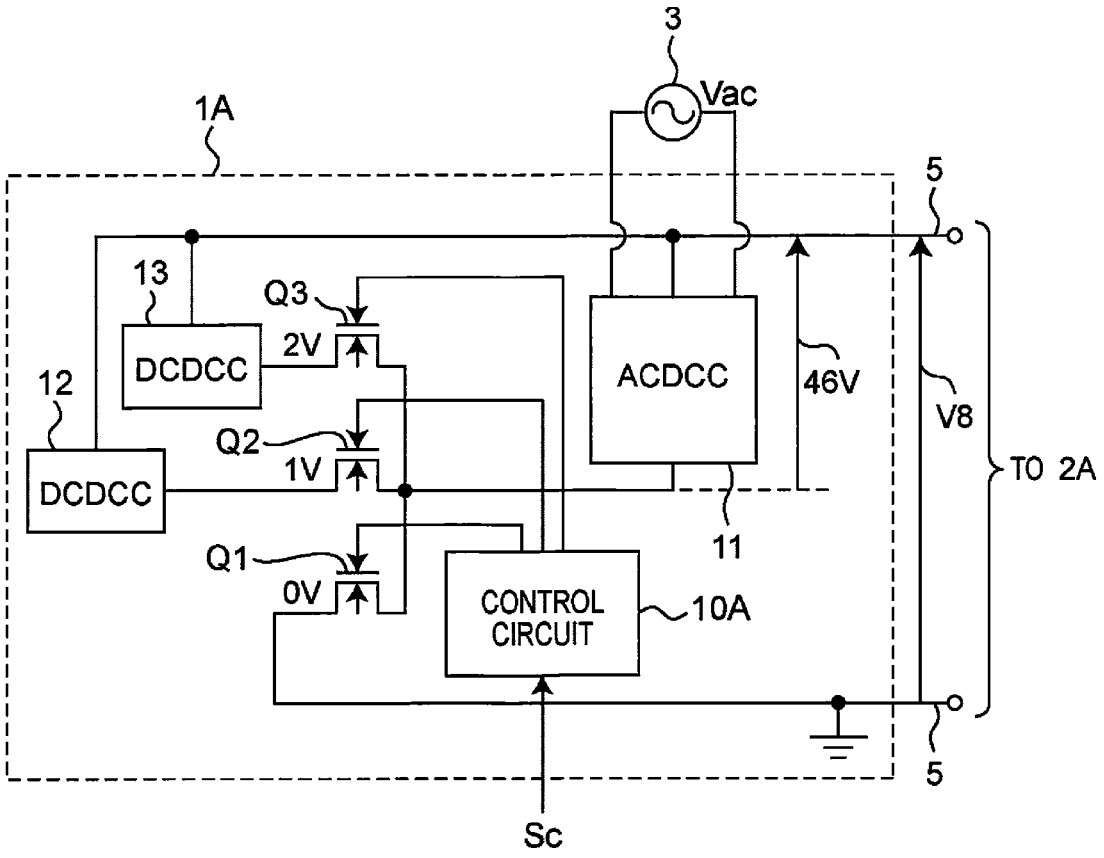
FIG. 5 is a block diagram illustrating a configuration example of a dimmer apparatus 1A of a lighting system according to a second embodiment.
Figure 6:
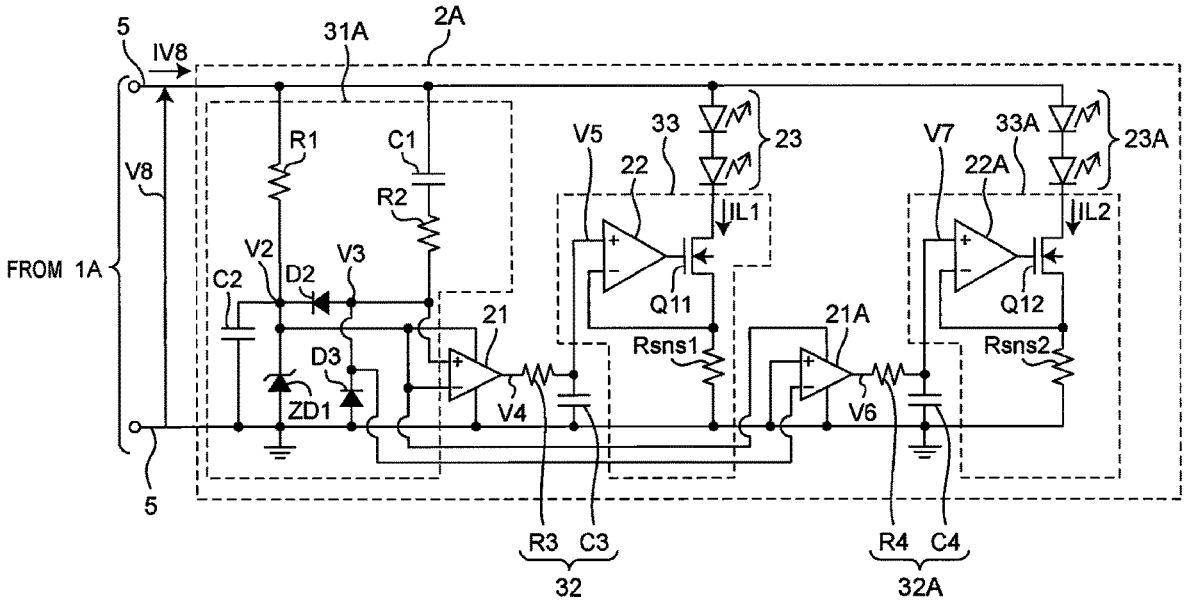
FIG. 6 is a circuit diagram illustrating a configuration example of lighting equipment 2A connected to the dimmer apparatus 1A of FIG. 5.
Figure 7:
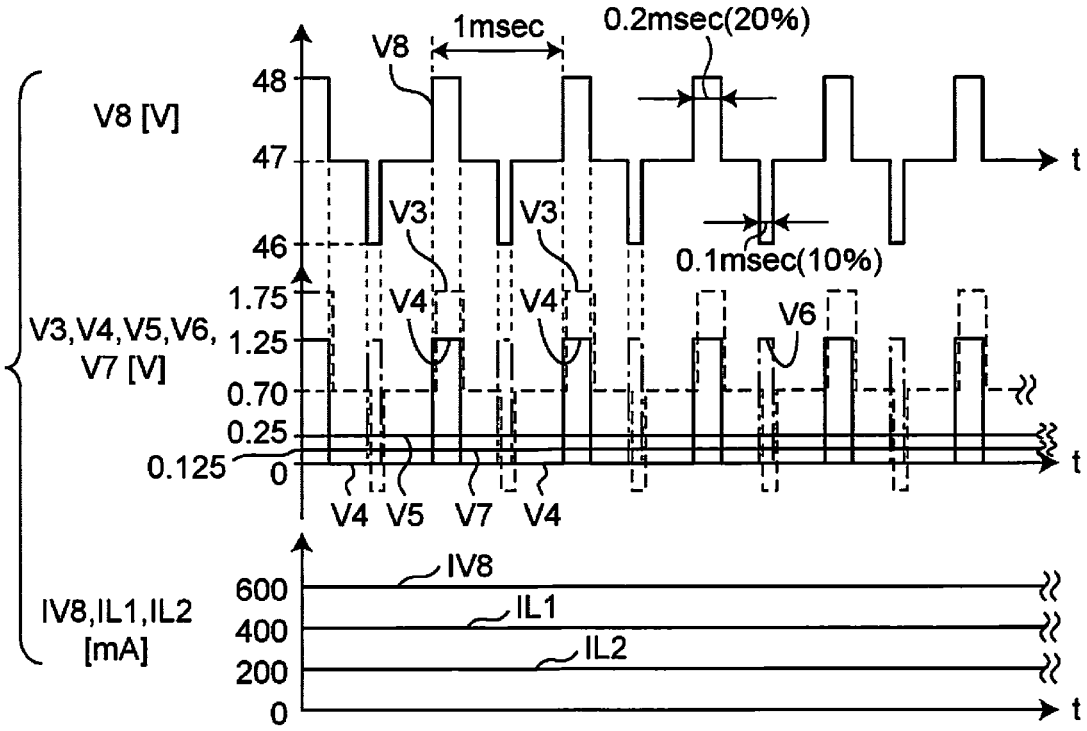
FIG. 7 is a timing chart of each of voltage waveforms and current waveforms, illustrating an operation example of the lighting system of FIGS. 5 and 6.

FIG. 5 is a block diagram illustrating a configuration example of a dimmer apparatus 1A of a lighting system according to a second embodiment. In addition, FIG. 6 is a circuit diagram illustrating a configuration example of lighting equipment 2A connected to the dimmer apparatus 1A of FIG. 5. Further, FIG. 7 is a timing chart of each of voltage waveforms and current waveforms, illustrating an operation example of the lighting system of FIGS. 5 and 6. It is noted that the configuration of the lighting system is similar to that in FIG. 1

Referring to FIGS. 5 and 6, the lighting system according to the second embodiment has the following differences from the configuration of the lighting system according to the first embodiment of FIGS. 1 to 3.

(1) The dimmer apparatus 1A is provided instead of the dimmer apparatus 1, and the specifics are as follows:

(1a) a control circuit 10A is provided instead of the control circuit 10; and (1b) a MOS transistor Q3 and a DC-DC converter 13 are further provided.

(2) The lighting equipment 2A is provided instead of the lighting equipment 2, and the specifics are as follows:

(2a) a voltage shift circuit 31A is provided instead of the voltage shift circuit 31; and (2b) a light emitting element 23A, a comparator 21A, a low-pass filter 32A, and a current control circuit 33A are further provided.

In particular, the lighting system according to the second embodiment has the following feature, as compared to the lighting system according to the first embodiment:

changing the dimming power supply voltage V1 including a PWM signal having two amplitudes to a dimming power supply voltage V8 including a PWM signal having three amplitudes, thereby driving and controlling two light emitting elements 23 and 23A. The differences will be described below.

In the dimmer apparatus 1A of FIG. 5, the negative electrode of the output terminal of the AC-DC converter 11 is further connected to the output terminal of the DC-DC converter 13 via the drain and source of the MOS transistor Q3. The DC-DC converter 13 converts the DC voltage generated by the AC-DC converter 11 into, for example, an output voltage of 2 V, to generate the output voltage, and outputs the generated 2 V output voltage from the output terminal to the negative terminal of the AC-DC converter 11 via the source and drain of the MOS transistor Q3.

The control circuit 10A receives the dimming control signal, turns on one of the MOS transistors Q1 and Q2, and Q3 so as to correspond to the dimming signal level of the dimming control signal, turns off the other to generate a PWM signal of 0 V, 1 V or 2 V, and applies the PWM signal to the negative terminal of the AC-DC converter 11 as a reference voltage of the AC-DC converter 11. In this case, (1) when the MOS transistor Q1 is turned on and the MOS transistors Q2, Q3 are turned off, the reference voltage of the AC-DC converter 11 is 0 V;

(2) in addition, when the MOS transistor Q2 is turned on and the MOS transistors Q1 and Q3 are turned off, the reference voltage of the AC-DC converter 11 is 1 V; and (3) further, when the MOS transistor Q3 is turned on and the MOS transistors Q1 and Q2 are turned off, the reference voltage of the AC-DC converter 11 is 2 V.

The dimming power supply voltage V8 from the dimmer apparatus 1A configured as described above is a power supply voltage including a superimposed PWM signal that changes between 46 V, 47 V, and 48 V.

The lighting equipment 2A of FIG. 6 includes the voltage shift circuit 31A, the comparators 21 and 21A, the low-pass filters 32 and 32A, the current control circuits 33, 33A, and the light emitting elements 23 and 23A. In this case, each of the light emitting elements 23 and 23A is, for example, a series circuit of a plurality of LEDs. The lighting equipment 2A receives the dimming power supply voltage V8, on which a PWM signal of 46 V, 47 V, or 48 V is superimposed from the dimmer apparatus 1A of FIG. 5, and causes the light emitting elements 23 and 23A to emit light, thereby controlling light adjustment.

Referring to FIG. 6, the voltage shift circuit 31A includes resistances R1 AND R2, capacitors C1 and C2, diodes D2 and D3, and a zener diode ZD1. In the voltage shift circuit 31 of FIG. 3, the two diodes D1 and D2 are connected in parallel, but in the voltage shift circuit 31A, the two diodes D2 and D3 are connected in series. In this case, a cathode of the diode D2 is connected to a connection between the resistance R1 and the capacitor C2, and an anode of the diode D2 is connected to the resistance R2 and a cathode of the diode D3. An anode of the diode D3 is grounded.

In this case, the reference voltage V2 at a connection between the resistance R1 and the capacitor C2 is applied to a positive power supply terminal of the comparator 21 and 21A in the subsequent stage, and is grounded to the negative terminal of the power supply voltage of the comparator 21 and 21A.

In the voltage shift circuit 31A configured as described above, the resistance R1 allows a bias current to flow through the zener diode ZD1 based on the dimming power supply voltage V8 from the dimmer apparatus 1A, so that the zener diode ZD1 generates a reference voltage V2 of 1.25 V. It is noted that the capacitor C2 connected in parallel with the zener diode ZD1 has a smoothing capacitance. In addition, the diodes D2 and D3 have a forward voltage VF of, for example, 0.5 V. The capacitor C1 level-shifts the PWM amplitude of the dimming power supply voltage V8 to the voltage V3, and outputs the voltage V3 to a non-inverting input terminal of the comparator 21 and an inverting input terminal of the comparator 21A. In this case, the non-inverting input terminal of the comparator 21A is grounded. Further, the resistance R2 is provided to limit an inrush current from the capacitor C1 to the diodes D3 and D2.

The signal voltage inputted to the non-inverting input terminal of the comparator 21 is clamped by the forward voltage VF of the diodes D2 and D3, so that signal voltage is the voltage V3 of the PWM signal that changes between −0.5 V and 1.75 V. Therefore, the voltage shift circuit 31A shifts the voltage of the PWM signal included in the dimming power supply voltage V1 that changes between 46 V and 47 V to the voltage V3 of the PWM signal that changes between −0.5 V and 1.75 V.

The voltage V2 across the zener diode ZD1 is inputted to the inverting input terminal of the comparator 21. Therefore, the output voltage V4 of the comparator 21 is the voltage of the PWM signal that changes between 0 V and 1.25 V. In addition, the voltage V3 is inputted to the non-inverting input terminal of the comparator 21A. Therefore, the comparator 21A outputs an output voltage of 1.25 V when the voltage V3 becomes equal to or lower than the reference voltage (0 V). Therefore, the voltage shift circuit 31A and the comparators 21 and 21A shift the voltage of the PWM signal that is included in the dimming power supply voltage V1 and changes between 47 V and 48 V to the voltage V4 of the PWM signal that changes between 0 V and 1.25 V, while shifting the voltage of the PWM signal that changes between 46 V and 47 V to the voltage V6 of the PWM signal that changes between 0 V and 1.25 V.

In a manner similar to that of the low-pass filter 32, the low-pass filter 32A is configured by connecting the resistance R4 and the capacitor C4 in an L shape, and smooths the output voltage V6 of the comparator 21A to generate a voltage V7. In this case, the voltage V7 is the duty ratio of the PWM signal×1.25 V.

The current control circuit 33A is a circuit that drives and controls the current of the light emitting element 23A, and includes an operational amplifier 22A, an N-channel MOS transistor Q12, and a resistance Rsns2, in a manner similar to that of the current control circuit 33. One end of the light emitting element 23A is connected to the positive electrode of a two-wire power supply line 5, and another end of the light emitting element 23A is connected to the negative electrode of the two-wire power supply line 5 grounded via the drain and source of the MOS transistor Q12 and the resistance Rsns2. In this case, the resistance Rsns2 is provided to detect a current IL2 flowing through the light emitting element 23A, and the voltage across the resistance Rsns2 is proportional to the current IL2.

The operational amplifier 22A applies the voltage obtained by subtracting the voltage across the resistance Rsns2 from the voltage V7 to the gate of the MOS transistor Q12, controls the gate voltage to be applied to the MOS transistor Q12, so that the voltage V7 and the voltage across the resistance Rsns2 substantially match. Therefore, assuming that the current flowing through the resistance Rsns2 is IL2, the current IL2 is feedback-controlled to be as follows:

$$IL2 = PWM \text{ signal duty ratio} \times 1.25/Rsns2.$$

Therefore, the operational amplifier 22A, the MOS transistor Q2, and the resistance Rsns2 form a feedback control circuit that controls the current IL2 flowing through the light emitting element 23A. It is noted that since the current IL2 flowing through the light emitting element 23A is sufficiently larger than the current flowing through the voltage shift circuit 31A, the current IV8 flowing through the lighting equipment 2A is substantially equal to the sum of the current IL1 and the current IL2.

In the lighting equipment 2A of FIG. 6 configured as described above, the voltage V3 is clamped at the maximum of 1.75 V and the minimum of −0.5 V as described above.

In this case, when the voltage V3 is clamped at the maximum of 1.75 V, (A) when the voltage V8 is 48 V, the voltage V3 is 1.75 V, (B) when the voltage V8 is 47 V, the voltage V3 is 0.75 V, and (C) when the voltage V8 is 46 V, the voltage V3 is −0.25 V.

Therefore, (A) when the voltage V8 is 48 V, the output voltage of the comparator 21 is 1.25 V, and (C) when the voltage V8 is 46 V, the output voltage of the comparator 21A is 1.25 V.

In addition, when the voltage V3 is clamped at the minimum of −0.5 V, (A) when the voltage V8 is 46 V, the voltage V3 is −0.5 V, (B) when the voltage V8 is 47 V, the voltage V3 is 0.5 V, and (C) when the voltage V8 is 48 V, the voltage V3 is 1.5 V.

Therefore, (C) when the voltage V8 is 48 V, the output voltage of the comparator 21 is 1.25 V, and (A) when the voltage V8 is 46 V, the output voltage of the comparator 21A is 1.25 V.

In the lighting equipment 2A of FIG. 6, for example, a cold color LED is used as the light emitting element 23, a warm color LED is used as the light emitting element 23A, and the ratio of the current flowing through each light emitting element 23 and 23A is adjusted, so that it is possible to provide an adjusting color (toning) function in combination with light adjustment.

The operation of the lighting equipment 2A configured as described above will be described below with reference to the timing chart of FIG. 7. It is noted that, in FIG. 7, the voltage V4 changes in synchronization with the voltages V8 and V3, but if these are superimposed and illustrated in the drawing, the voltage waveform becomes unclear. Therefore, for convenience of illustration, the voltage V4 is slightly shifted in the time direction from the voltages V8 and V3 in the drawing. In this case, the period of the PWM signal is 1 msec (frequency 1 kHz), the duty ratio of the PWM signal is 20% (0.2 msec) at 48 V and 10% (0.1 msec) at 46 V, and the resistance value of the resistances Rsns1 and Rsns2 is 0.625Ω.

As is clear from FIG. 7, the voltage V8 including the PWM signal that changes between 46 V, 47 V or 48 V is shifted through the voltage V3 to the voltages V4, V6 each including the PWM signal that changes between 0 V and 1.25 V. In FIG. 7, the currents IL1 and IL2 are expressed by the following equations:

$$IL1 = 20\% \times 1.25\text{ V}/0.625\Omega = 400\text{ mA; and}$$

$$IL2 = 10\% \times 1.25\text{ V}/0.625\Omega = 200\text{ mA.}$$

In the second embodiment, since the control voltages of the two light emitting elements 23 and 23A are included in one PWM signal, the duty ratio cannot be set to 100% as in the first embodiment. However, by setting the resistance values of the resistances Rsns1 and Rsns2 to half of those of the first embodiment, it is possible to cause the same current as in the case where the duty ratio in the first embodiment is 100% to flow even when each of resistance values of the resistances Rsns1 and Rsns2 is 50%. Further, it can be seen that there is almost no noise at the current IV8.

According to the lighting system according to the second embodiment configured as described above, the dimmer apparatus 1A generates the DC voltage V8 including the dimming PWM signal having three amplitudes corresponding to the dimming control signal, and outputs the DC voltage V8 to the lighting equipment 2A. In addition, the lighting equipment 2A includes:

the light emitting elements 23 and 23A, that have the forward voltage VF lower than the DC voltage V8 inputted from the dimmer apparatus 1A and emit light by the DC currents IL1 and 112 based on the DC voltage V8; and a current control circuit, that demodulates the dimming PWM signal included in the DC voltage V8, and controls the brightness of the light emitting elements 23 and 23A, so that the DC currents IL1 and IL2 further corresponding to two duty ratios of the dimming PWM signal corresponding to two amplitudes of the modulated PWM signal flow through the light emitting elements 23 and 23A.

Therefore, the lighting system according to the second embodiment has the following unique effects.

(1) Since the lighting equipment 2A does not require a control circuit such as a microcomputer and a memory and a bulk capacitor, the configuration is simple, the size can be reduced, and the noise is small as compared with the prior art.

(2) Since the dimmer apparatus 1A and the lighting equipment 2A are connected to each other via the two-wire power supply line 5, the construction is extremely easy.

(3) Since the PWM signal has three amplitude levels as in the second embodiment, each LED of two colors can be controlled, so that the color adjustment (toning) can be performed.

Third Embodiment

Figure 8:
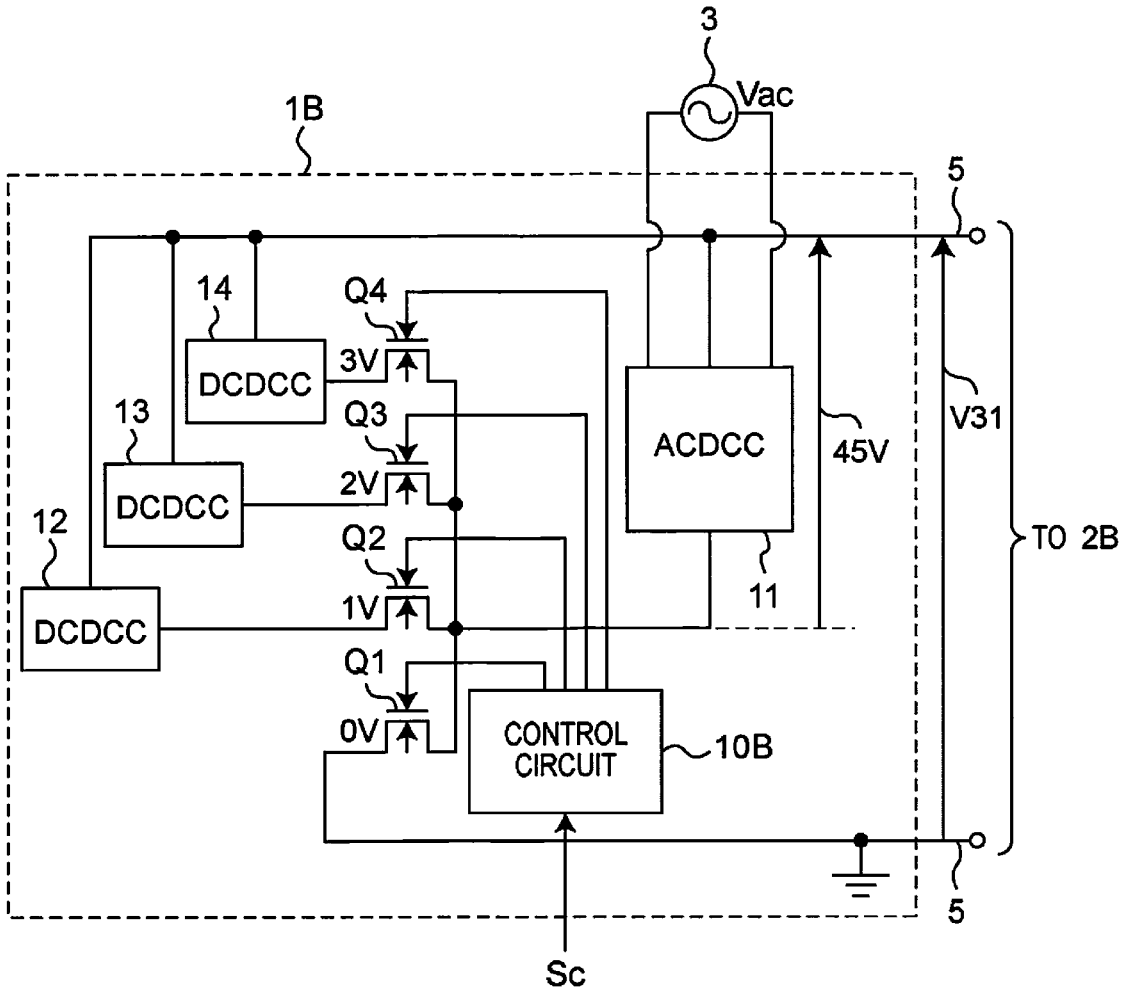
FIG. 8 is a block diagram illustrating a configuration example of a dimmer apparatus 1B of a lighting system according to a third embodiment.
Figure 9:
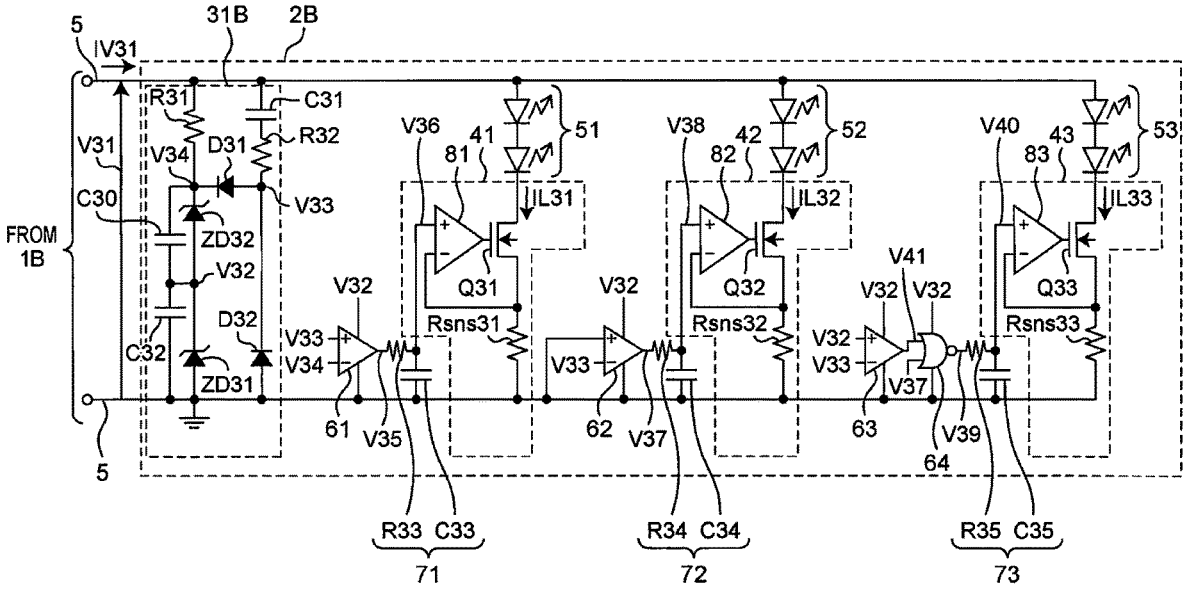
FIG. 9 is a circuit diagram illustrating a configuration example of lighting equipment 2B connected to the dimmer apparatus 1B of FIG. 8.
Figure 10:
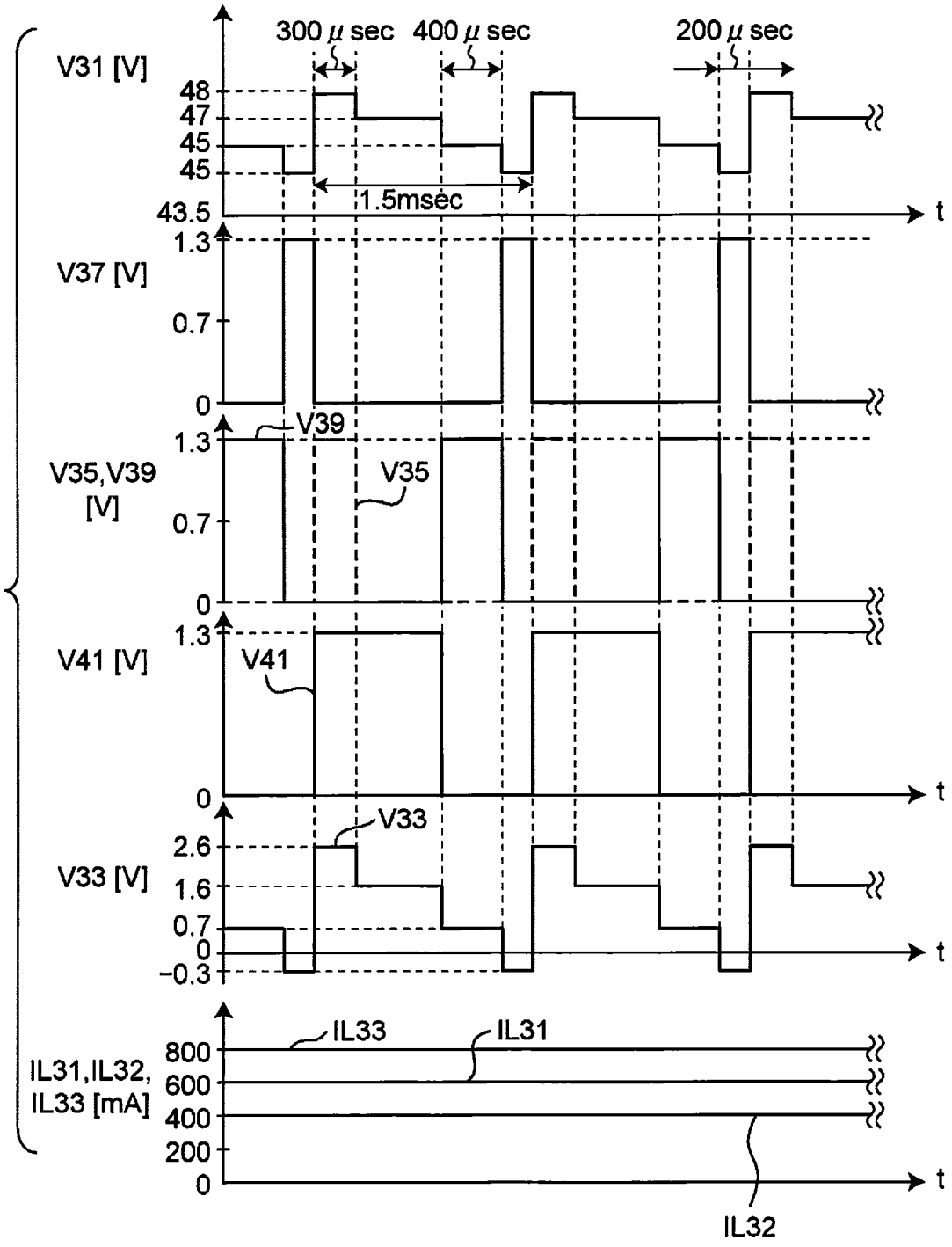
FIG. 10 is a timing chart of each of voltage waveforms and current waveforms, illustrating an operation example of the lighting system of FIGS. 8 and 9.

FIG. 8 is a block diagram illustrating a configuration example of a dimmer apparatus 1B of a lighting system according to a third embodiment. In addition, FIG. 9 is a circuit diagram illustrating a configuration example of lighting equipment 2B connected to the dimmer apparatus 1B of FIG. 8. Further, FIG. 10 is a timing chart of each of voltage waveforms and current waveforms, illustrating an operation example of the lighting system of FIGS. 8 and 9. It is noted that the configuration of the lighting system is similar to that in FIG. 1

Referring to FIGS. 8 and 9, the lighting system according to the third embodiment has the following differences from the configuration of the lighting system according to the second embodiment of FIGS. 5 to 7.

(1) The dimmer apparatus 1B is provided instead of the dimmer apparatus 1A, and the specifics are as follows:

(1a) a control circuit 10B is provided instead of the control circuit 10A; and (1b) a MOS transistor Q4 and a DC-DC converter 14 are further provided.

(2) The lighting equipment 2B is provided instead of the lighting equipment 2A, and the specifics are as follows:

(2a) a voltage shift circuit 31B is provided instead of the voltage shift circuit 31A; and (2b) three light emitting elements 51 to 53, comparators 61 to 63, low-pass filters 71 to 73, and current control circuits 41 to 43 are provided.

In particular, the lighting system according to the third embodiment has the following feature, as compared to the lighting system according to the second embodiment:

changing the dimming power supply voltage V8 including a PWM signal having three amplitudes to a dimming power supply voltage V31 including a PWM signal having four amplitudes to drive, thereby controlling three light emitting elements 51 to 53. The differences will be described below.

In the dimmer apparatus 1B of FIG. 8, the negative electrode of the output terminal of the AC-DC converter 11 is further connected to the output terminal of the DC-DC converter 14 via the drain and source of the MOS transistor Q4. The DC-DC converter 14 converts the DC voltage generated by the AC-DC converter 11 into, for example, an output voltage of 3 V, to generate the output voltage, and outputs the generated 3 V output voltage from the output terminal to the negative terminal of the AC-DC converter 11 via the source and drain of the MOS transistor Q4. It is noted that the AC-DC converter 11 generates a voltage of, for example, 45 V.

The control circuit 10B receives the dimming control signal, turns on either one of the MOS transistors Q1, Q2, Q3, and Q4 correspondingly to the dimming signal level of the dimming control signal, turns off the other to generate a PWM signal of 0 V, 1 V, 2 V, or 3 V, and then, applies the PWM signal to the negative terminal of the AC-DC converter 11 as a reference voltage of the AC-DC converter 11.

(1) When the MOS transistor Q1 is turned on and the MOS transistors Q2, Q3, and Q4 are turned off, the reference voltage of the AC-DC converter 11 is 0 V.

(2) When the MOS transistor Q2 is turned on and the MOS transistors Q1, Q3, and Q4 are turned off, the reference voltage of the AC-DC converter 11 is 1 V.

(3) When the MOS transistor Q3 is turned on and the MOS transistors Q1, Q2, and Q4 are turned off, the reference voltage of the AC-DC converter 11 is 2 V.

(4) When the MOS transistor Q4 is turned on and the MOS transistors Q1, Q2, and Q3 are turned off, the reference voltage of the AC-DC converter 11 is 3 V.

The dimming power supply voltage V31 from the dimmer apparatus 1B configured as described above is a power supply voltage including a superimposed PWM signal that changes between 45 V, 46 V, 47 V, and 48 V.

The lighting equipment 2B of FIG. 9 includes the voltage shift circuit 31B, the comparators 61, 62, and 63, the low-pass filter 71, 72, and 73, the current control circuits 41, 42, and 43, and the light emitting elements 51, 52, and 53. In this case, each of the light emitting elements 51 to 53 is, for example, a series circuit of a plurality of LEDs. The lighting equipment 2B receives the dimming power supply voltage V31, on which a PWM signal of 45 V, 46 V, 47 V, or 48 V is superimposed from the dimmer apparatus 1B of FIG. 7, and causes the light emitting elements 51 to 53 to emit light, thereby controlling light adjustment.

Referring to FIG. 9, the voltage shift circuit 31B includes resistances R31, R32, capacitors C31 and C32, diodes D31, D32, and D33 and zener diodes ZD31 and ZD32. In a manner similar to that of the voltage shift circuit 31A of FIG. 7, two diodes D31 and D32 are connected in series. In this case, a cathode of the diode D31 is connected to a connection between the resistance R31 and the capacitor C30, and an anode of the diode D31 is connected to the resistance R32 and a cathode of the diode D32. The anode of the diode D32 is grounded. Further, the voltage V2 of FIG. 6 is divided by a parallel circuit of the capacitor C30 and the zener diode ZD32 and a parallel circuit of the capacitor C32 and the zener diode ZD31, and the voltage at the connection of each parallel circuit is the voltage V32.

In addition, the reference voltage V34 is inputted to the inverting input terminal of the comparator 61. Further, the voltage V33 at the connection of the diodes D31 and D32 is applied to a non-inverting input terminal of the comparator 61 and each inverting input terminal of the comparators 62 and 63. The voltage V32 at the connection of the zener diodes ZD32 and ZD31 is applied to the non-inverting input terminal of the comparator 63, the positive power supply terminal of each of the comparators 61 to 63, and the positive power supply terminal of a NOR Gate 64.

The low-pass filter 71 is configured by connecting the resistance R33 and the capacitor C33 in an L shape, smooths the output voltage V35 of the comparator 61 to generate a voltage V36, and outputs the voltage V36 to the non-inverting input terminal of an operational amplifier 81. The low-pass filter 72 is configured by connecting the resistance R34 and the capacitor C34 in an L shape, smooths the output voltage V37 of the comparator 62 to generate a voltage V38, and outputs the voltage V38 to the non-inverting input terminal of the operational amplifier 82. The low-pass filter 73 is configured by connecting the resistance R35 and the capacitor C35 in an L shape, smooths the voltage inputted from the output voltage V41 of the comparator 63 via the NOR gate 64 to generate a voltage V40, and outputs the voltage V40 to the non-inverting input terminal of the operational amplifier 83. It is noted that the voltage V41 and the voltage V37 are applied to the NOR gate 64, and the NOR gate 64 is provided to drive and control the light emitting element 54 with the voltage obtained by the operation result of the negative OR of these voltages.

The current control circuit 41 is a circuit that drives and controls the current of the light emitting element 51, and includes an operational amplifier 81, an N-channel MOS transistor Q31, and a resistance Rsns31, in a manner similar to that of the current control circuit 33 of FIG. 3, and operates in a manner similar to that of the current control circuit 33 of FIG. 3. The current control circuit 42 is a circuit that drives and controls the current of the light emitting element 52, and includes an operational amplifier 82, an N-channel MOS transistor Q32, and a resistance Rsns32, in a manner similar to that of the current control circuit 33 of FIG. 3, and operates in a manner similar to that of the current control circuit 33 of FIG. 3. The current control circuit 43 is a circuit that drives and controls the current of the light emitting element 53, and includes an operational amplifier 83, an N-channel MOS transistor Q33, and a resistance Rsns33, in a manner similar to that of the current control circuit 33 of FIG. 3, and operates in a manner similar to that of the current control circuit 33 of FIG. 3.

It is noted that the light emitting elements 51 to 53 of the lighting equipment 2B are, for example, a red LED, a green LED, and a blue LED, which are capable of emitting three colors, and it is possible to provide a color adjusting (toning) function in combination with light adjustment by adjusting the ratio of the current flowing through the light emitting elements 51 to 53.

In the timing chart of FIG. 10, the period of the PWM signal is 1.5 msec (frequency 666 Hz), and the duty ratio of the PWM signal is 0.3 msec at 48 V, 0.4 msec at 46 V, and 0.2 msec at 45 V. The resistance value of each of the resistances Rsns31, Rsns32, Rsns33 is set to 1.25/3Ω.

In the present embodiment, since the drive currents of the light emitting elements 51 to 53 are adjusted with the duty ratios of 48 V, 46 V and 45 V of the PWM signal, each duty ratio cannot be set to 100%. However, by setting the resistance value of each of the resistances Rsns31, Rsns32, Rsns33 to ⅓ of the resistance value of FIG. 3, it is possible to allow the same drive current as that with the duty ratio of FIG. 3 being 100%, to flow through the light emitting elements 51 to 53 when the duty ratio of each of the resistance values is 100/3% (0.5 msec).

According to the lighting system according to the third embodiment configured as described above, the dimmer apparatus 1B generates the DC voltage V31 including the dimming PWM signal having four amplitudes corresponding to the dimming control signal, and outputs the DC voltage V31 to lighting equipment 2B. In addition, the lighting equipment 2B includes:

the light emitting elements 51 to 53, that have the forward voltage VF lower than the DC voltage V31 inputted from the dimmer apparatus 1B and emit light by the DC currents IL31, IL32, and IL33 based on the DC voltage V31; and a current control circuit, that demodulates the dimming PWM signal included in the DC voltage V31 and controls the brightness of the light emitting elements 51 to 53, so that the DC currents IL31, IL32, and IL33 further corresponding to the duty ratio of the dimming PWM signal corresponding to three amplitudes of the modulated PWM signal flow through the light emitting elements 51 to 53A.

Therefore, the lighting system according to the third embodiment has the following unique effects.

(1) Since the lighting equipment 2B does not require a control circuit such as a microcomputer and a memory and a bulk capacitor, the configuration is simple, the size can be reduced, and the noise is small as compared with the prior art.

(2) Since the dimmer apparatus 1B and the lighting equipment 2B are connected to each other via a two-wire power supply line 5, the construction is extremely easy.

(3) Since the PWM signal has four amplitude levels as in the third embodiment, each LED of red, green, and blue, for example, can be controlled, so that the light emission can be adjusted to be an arbitrary color by color toning.

Effects of Embodiments and the Like

In the above embodiments, the PWM amplitude (ground voltage) of the PWM signal is preferably equal to or smaller than a predetermined safety extra low voltage (SELV), which is, for example, a DC voltage of 60 V. Setting the PWM amplitude to equal to or smaller than the safety extra low voltage (SELV) eliminates the need for insulation on the lighting equipment side, making the lighting equipment smaller and lighter. The safety extra low voltage (SELV) varies depending on the standard, but is a DC of 120 V or lower in JIS C 8105-1, for example.

Further, it is preferable that the PWM amplitude (ground voltage) of the PWM signal is equal to or lower than 50 V. In this case, it has the advantage of eliminating the need for an electrician's qualification as required by the Electricians Act, when wiring or connecting the dimmer apparatus and the lighting equipment using a two-wire power supply line.

In addition, the circuits of the lighting equipment 2, 2A, and 2B are preferably mounted on a single substrate, and in this case, the lighting equipment can be made smaller and lighter. Further, if the substrate is an aluminum substrate, the heat dissipation capacity increases and high-density mounting becomes possible.

Modified Embodiments

In the above embodiments, a predetermined voltage value is set as the output voltage of each circuit, but the present invention is not limited to this, and may be changed within the scope of the design.

In the above embodiments, the lighting system that drives and controls one, two, and three light emitting elements has been described, but the present invention is not limited to this, and a lighting system that drives and controls four or more light emitting elements may be configured in a similar manner. In this case, by providing three or more light emitting elements, the lighting color of the lighting equipment can be arbitrarily changed (or toned).

Industrial Applicability

As described in detail above, the present invention can be applied to a lighting system including a dimmer apparatus and lighting equipment connected to each other via a two-wire power line.

The invention claimed is:

1. A lighting system comprising a dimmer apparatus and lighting equipment that are connected to each other via a two-wire power supply line, wherein the dimmer apparatus generates a DC voltage including a dimming PWM signal having a PWM amplitude corresponding to a dimming control signal, and outputs the DC voltage to the lighting equipment, and wherein the lighting equipment comprises:

at least one light emitting element that emits light by a DC current based on the DC voltage; and a current control circuit that modulates the dimming PWM signal included in the DC voltage, and controls brightness of the light emitting element, so that a DC current corresponding to a duty ratio of a modulated dimming PWM signal flows through the light emitting element based on the duty ratio of the dimming PWM signal, wherein the current control circuit comprises:

a current detection circuit that detects a current flowing through the light emitting element, and outputs a detection voltage proportional to the current;

a voltage shift circuit that shifts the DC voltage including the dimming PWM signal from the dimmer apparatus, to a DC voltage including a PWM signal having a predetermined voltage range;

a smoothing filter that smooths the DC voltage including the PWM signal having the predetermined voltage range, and generates a predetermined DC voltage; and a feedback control circuit that drives and controls the current flowing through the light emitting element, so that the detection voltage from the current detection circuit substantially matches the DC voltage from the smoothing filter.

2. The lighting system as claimed in claim 1, wherein the dimmer apparatus comprises:

a first converter that converts an AC voltage into a predetermined first DC voltage;

at least one second converter that converts a converted first DC voltage, into at least one predetermined second DC voltage; and a control circuit that controls so as to generate the DC voltage including the dimming PWM signal, by using the first DC voltage and the second DC voltage or another DC voltage to selectively switch over based on the dimming control signal.

3. The lighting system as claimed in claim 2, further comprising a plurality of switching elements that switch over whether or not each of the second converter is connected to the first converter, wherein the control circuit controls the plurality of switching elements to generate the DC voltage including the dimming PWM signal, by using the first DC voltage and each of the second DC voltage to selectively switch over whether or not each of the second DC voltage is added to the first DC voltage based on the dimming control signal.

4. The lighting system as claimed in claim 1, wherein the lighting equipment comprises a plurality of the light emitting element, wherein the dimming PWM signal includes a reference voltage and a plurality of PWM amplitude voltages of the same number as that of the plurality of light emitting element, and wherein the current control circuit controls brightness of the plurality of light emitting element, so that a plurality of DC currents corresponding to a plurality of duty ratios of a dimming PWM signal corresponding to plurality of modulated PWM amplitudes flow through each of the light emitting element based on the plurality of duty ratios of the dimming PWM signal.

5. The lighting system as claimed in claim 1, wherein the number of the light emitting element is three or more.

6. The lighting system as claimed in claim 1, wherein the PWM amplitude is equal to or smaller than a predetermined safety extra low voltage (SELV).

7. The lighting system as claimed in claim 1, wherein the DC voltage generated by the dimmer apparatus is 50 V or lower.

8. The lighting system as claimed in claim 1, wherein the lighting equipment is mounted on a single substrate.

* * * * *